US012460287B2

(12) United States Patent
Zhan et al.

(10) Patent No.: US 12,460,287 B2
(45) Date of Patent: Nov. 4, 2025

(54) METHOD FOR FORMING GOURD PETAL COMPONENT USING ELECTRIC PULSE CREEP AGING

(71) Applicant: Central South University, Changsha (CN)

(72) Inventors: Lihua Zhan, Changsha (CN); Shengmeng Hui, Changsha (CN); Yongqian Xu, Changsha (CN)

(73) Assignee: Central South University, Changsha (CN)

( * ) Notice: Subject to any disclaimer, the term of this patent is extended or adjusted under 35 U.S.C. 154(b) by 0 days.

(21) Appl. No.: 18/784,656

(22) Filed: Jul. 25, 2024

(65) Prior Publication Data

US 2025/0223681 A1 Jul. 10, 2025

(30) Foreign Application Priority Data

Jan. 10, 2024 (CN) ..... 202410036429.X

(51) Int. Cl.
*C22F 1/04* (2006.01)

(52) U.S. Cl.
CPC ..... *C22F 1/04* (2013.01)

(58) Field of Classification Search
CPC ..... C22F 1/04
See application file for complete search history.

(56) References Cited

FOREIGN PATENT DOCUMENTS

| | | | |
|---|---|---|---|
| CN | 207197955 U | * | 4/2018 |
| CN | 111575615 A | | 8/2020 |
| CN | 112264517 A | | 1/2021 |
| CN | 113083985 A | | 7/2021 |
| CN | 113141680 A | | 7/2021 |
| JP | 2011183418 A | * | 9/2011 |

OTHER PUBLICATIONS

English machine translation of JP-2011183418-A (Year: 2011).*
Lam, Aaron CL, et al. "A method for designing lightweight and flexible creep-age forming tools using mechanical splines and sparse controlling points." The International Journal of Advanced Manufacturing Technology 80 (2015): 361-372. (Year: 2015).*
English machine translation of CN-207197955-U (Year: 2018).*
Zhou, Chang, Lihua Zhan, and He Li. "Improving creep age formability of an Al-Cu-Li alloy by electropulsing." Journal of Alloys and Compounds 870 (2021): 159482. (Year: 2021).*

* cited by examiner

*Primary Examiner* — Keith D. Hendricks
*Assistant Examiner* — Joshua S Carpenter
(74) *Attorney, Agent, or Firm* — George D. Morgan

(57) ABSTRACT

A method for forming a gourd petal component is provided. The method includes obtaining a sheet material with M installation ends. Second wires are divided into M groups based on a cross-sectional area of each installation end. The sheet material is installed on a flexible mold. First wires and the second wires are connected to the sheet material and a current cabinet respectively. A power supply is turned on, electric pulses are applied to M areas including different installation ends for heating. When a temperature of the sheet material reaches a creep aging temperature, a load is applied on a top of the flexible mold to adsorb the sheet material. A creep aging forming is maintained for a preset time under the load and a high temperature. Once the load and the external current are unloaded, the gourd petal component is obtained after a cooling.

8 Claims, 11 Drawing Sheets

METHOD FOR FORMING GOURD PETAL COMPONENT USING ELECTRIC PULSE CREEP AGING

CROSS-REFERENCE TO RELATED APPLICATIONS

The application claims priority to Chinese patent application No. 202410036429.X, filed on Jan. 10, 2024, the entire contents of which are incorporated herein by reference.

TECHNICAL FIELD

The present application belongs to a field of metal component forming Technology, and in particular to a method for forming a gourd petal component using an electric pulse creep aging.

BACKGROUND

A tank bottom, as a key component of a launch vehicle's fuel tank, is currently mainly processed by a block forming followed by a stitch welding. The tank bottom includes a main body assembled by 8-12 gourd petals and a top cover provided on a top surface side of the main body. The main body is a truncated cone with openings at both ends, and the gourd petal has an isosceles trapezoidal structure with a certain curvature.

The existing technology mainly forms the gourd petal through a process of a creep aging forming, which specifically includes: providing a sheet material with a same flattened structure as the gourd petal, and fixing the sheet material on a mold surface of a forming mold, heating the sheet material through an autoclave or an electric pulse, and keeping the sheet material at a preset temperature for a certain time length to complete the creep aging forming. However, a gourd petal component obtained through the existing technology generally has a low quantity.

SUMMARY

In one aspect, the present application provides a method for forming a gourd petal component using an electric pulse creep aging, wherein the gourd petal component has a curved surface structure, and has an isosceles trapezoidal shape when the gourd petal component is flattened, wherein the method comprises following steps:

Step (1), providing a sheet material, and processing the sheet material into a sheet material to be formed having a preset shape, wherein the sheet material to be formed comprises a main body having a structure same as a flattened structure of the gourd petal component, and two stepped parts which are symmetrically arranged and located on both sides of the main body, each of the stepped parts comprising a plurality of stepped platforms arranged parallel to a bottom surface of the main body, and a sum of lengths of all the stepped platforms and a length of a small end of the main body is equal to a length of a large end of the main body, and two stepped platforms located on an uppermost end are in a same plane as a top surface of the main body, wherein all the stepped platforms and the small end of the main body together form M installation ends of different heights, and M is a positive integer greater than or equal to 2;

Step (2), providing a plurality of first wires and a plurality of second wires, a total number of the first wires being the same as a total number of the second wires; and dividing all the second wires into M groups of second wires based on cross-sectional areas of the M installation ends, the M installation ends corresponding to the M groups of second wires in a one-to-one correspondence, and a number of second wires corresponding to a unit cross-sectional area of each installation end being the same;

Step (3), installing the sheet material to be formed on a flexible mold, and connecting one end of each of the plurality of first wires to a bottom end of the sheet material to be formed and connecting the other end of each first wire to a current cabinet, and connecting one end of each second wire in each group of second wires to the corresponding installation end and connecting the other end of each second wire to the current cabinet, wherein the plurality of first wires and the plurality of second wires are respectively arranged opposite to each other and are evenly distributed;

Step (4), turning on a power supply, applying electric pulses to M areas including different installation ends respectively, so that a current flows from one end of the sheet material to be formed to the other end of the sheet material to be formed to heat each area of the M areas of the sheet material to be formed respectively, each area of the M areas having a regular shape and a current density applied to each area is the same;

Step (5), when the temperature of the sheet material to be formed reaches a creep aging temperature, adjusting the flexible mold to form a target mold surface, and applying a load through a vacuum sucker on a top of the flexible mold to adsorb the sheet material to be formed, the target mold surface matching a shape of the gourd petal component;

Step (6), maintaining a temperature generated by a load and an electric pulse for a preset time length to allow the sheet material to be formed to undergo a creep aging forming, and unloading the load and the current that is applied, and obtaining the gourd petal component including an edge material after a rebound.

In a specific embodiment, the step (2) comprises:

Based on a number of connection ports of a positive shunt bar and a number of connection ports of a negative shunt bar connected to the current cabinet, providing the plurality of first wires and the plurality of second wires of the same number;

Calculating a cross-sectional area of each of the installation ends separately;

Determining a number of second wires to be installed at each installation end based on the total number of the second wires and the cross-sectional area of each installation end;

Based on the determined number of second wires to be installed at each installation end, dividing all the second wires into the M groups of second wires, the M installation ends correspond to the M groups of second wires one by one, and a number of second wires corresponding to a unit cross-sectional area of each installation end being the same.

In a specific embodiment, in step (4), electric pulses are applied to a plurality of areas at off-peak hours, and a sum of duty cycles of pulse current applied to each area is less than 100%.

In a specific implementation, the cross-sectional area of each installation end is the same, the number of second wires installed on each installation end is the same, and the duty cycle of the pulse current in each area is the same.

In a specific embodiment, the sheet material to be formed is a 2195-T34 aluminum-lithium alloy, the corresponding creep aging temperature is 160~185° C., and the preset time is 3~20 h.

In a specific implementation, when the creep aging temperature is maintained at 185° C., the preset time is 3 to 5 hours; when the creep aging temperature is maintained at 160° C., the preset time is 20 to 25 hours.

In a specific embodiment, pulse parameters corresponding to the electric pulse applied in step (4) are determined by the following method, comprising:

determining pulse parameters for reaching a target temperature based on an experiment with given pulse parameters making for the sheet material to be formed, the target temperature being a preset temperature of a creep age forming, wherein the pulse parameters comprise a pulse frequency, a pulse current density, and a duty cycle;

Based on the pulse parameters that have been determined, maintaining a temperature of a creep age deformation at the target temperature by adjusting a current using a proportion integration differentiation (PID).

In a specific implementation, a number of the stepped platforms of each of the stepped parts is 3 to 5, and correspondingly, the number M of the installation ends is 3 to 5.

In a specific embodiment, the two stepped platforms at the uppermost end and the small end of the main body together serve as one installation end, and other stepped platforms except the two stepped platforms at the uppermost end form M-1 installation ends, and each two stepped platforms at a same height serve as one installation end.

In a specific embodiment, the method further comprises a shaping step, in which a separate pulse heating is performed on a rectangular area comprising an under-formed part or a difficult-to-deform part.

DETAILED DESCRIPTION OF THE EMBODIMENTS

Embodiments of the present application are described in detail below with reference to accompanying drawings. However, the present application can define and cover various different implementations according to claims.

In one embodiment, in forming a gourd petal component through a process of a creep aging forming, when a sheet material to be formed is heated by an electric pulse, since the sheet material to be formed has an isosceles trapezoidal structure, and a cross-sectional areas corresponding to a small end is different from a cross-sectional areas corresponding to a large end, i.e., an irregular shape. A number of wires installed at the small end is the same as a number of wires installed at the large end, when the component is heated by the electric pulse, a current density at the small end is larger, and a current distribution of the entire sheet material is uneven. However, the uneven current distribution leads to following problems: on one hand, the uneven current distribution leads to inconsistent electronic wind forces at different parts of the sheet material, and inconsistent deformation behaviors of different parts during a creep process affects a forming quality; on another hand, the uneven current distribution leads to uneven Joule heat distribution at different parts of the sheet material, thereby an influence degree of forming different parts of the sheet material is inconsistent.

A method of forming a gourd petal component by utilizing an electric pulse creep aging provided by the present application processes a side of a sheet material to be formed into a stepped shape so that the sheet material to be formed is composed of a plurality of rectangular blocks with different lengths, thereby facilitating an arrangement of positive power lines and negative power lines at both ends of the rectangular blocks. By controlling a number of power lines installed at both ends of the sheet material to be formed, a current density of each area of the sheet material to be formed is ensured to be close to each other, thereby achieving a purpose of a relative temperature uniformity and improving a forming quality of the gourd petal component.

Figure 1:
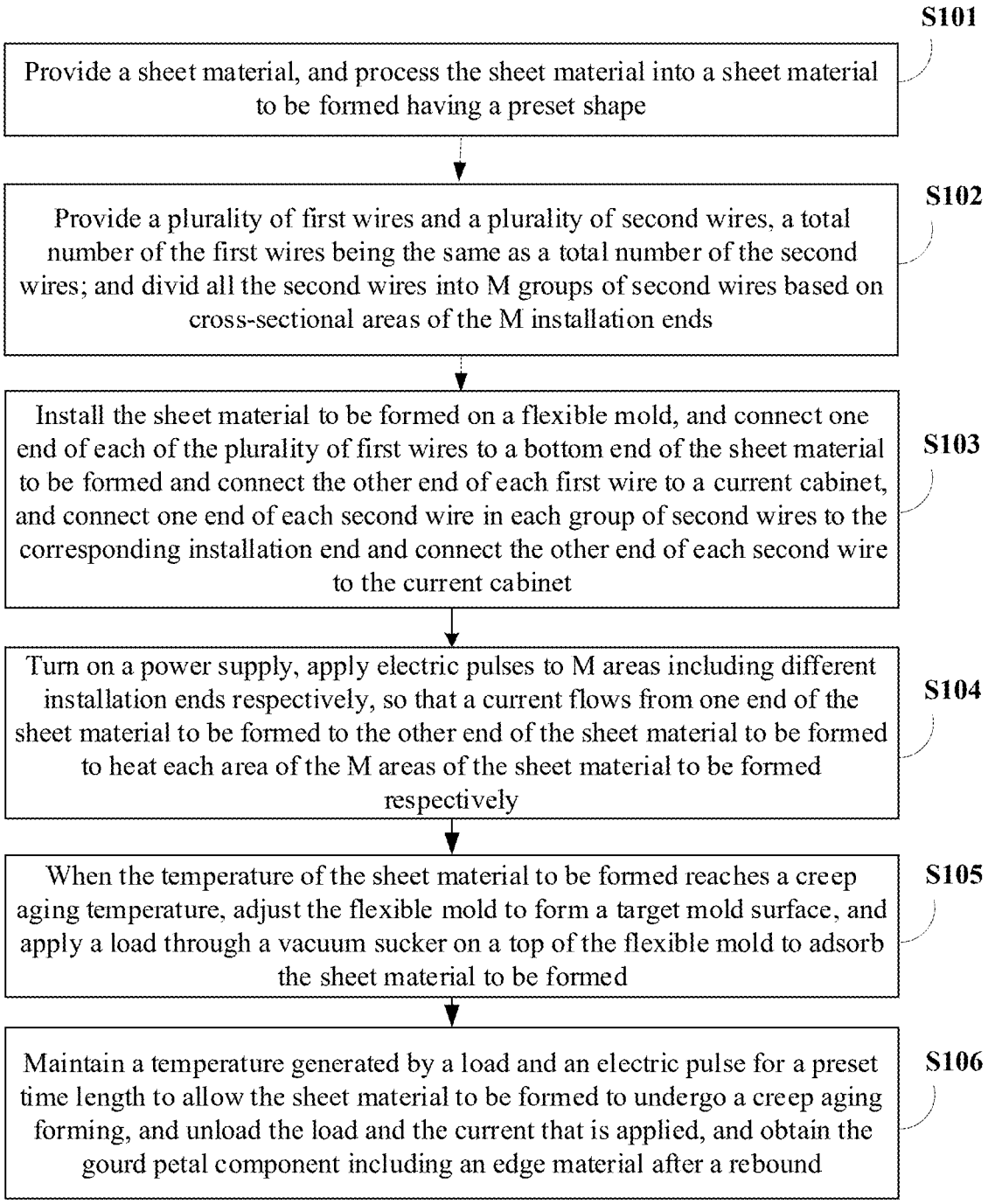
FIG. 1 is a flowchart of a method for forming a gourd petal component by using an electric pulse creep aging according to an embodiment of the present application.
Figure 2:
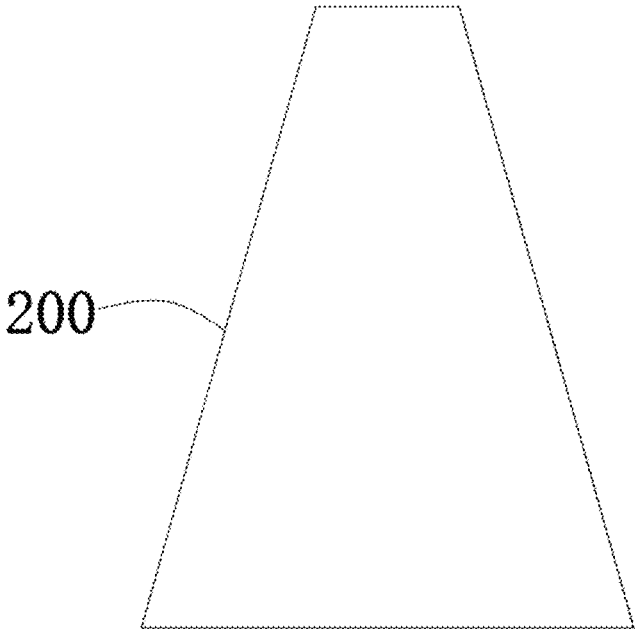
FIG. 2 is a schematic structural diagram of a flattened structure of a gourd petal component provided by the present application at an angle.
Figure 3:
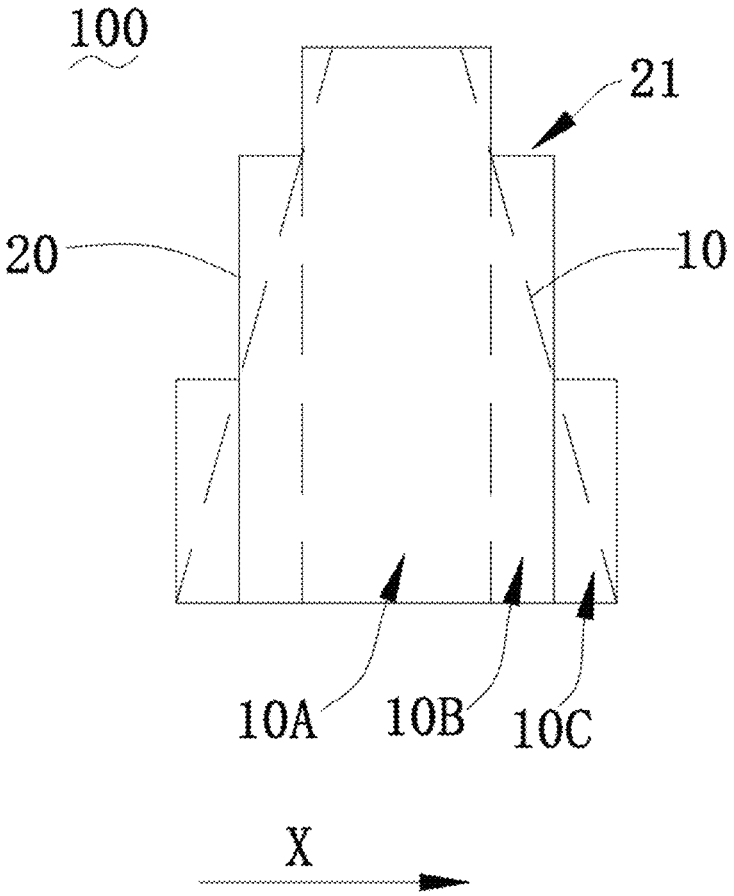
FIG. 3 is a schematic structural diagram of a sheet material to be formed provided by the present application at an angle.
Figure 4:
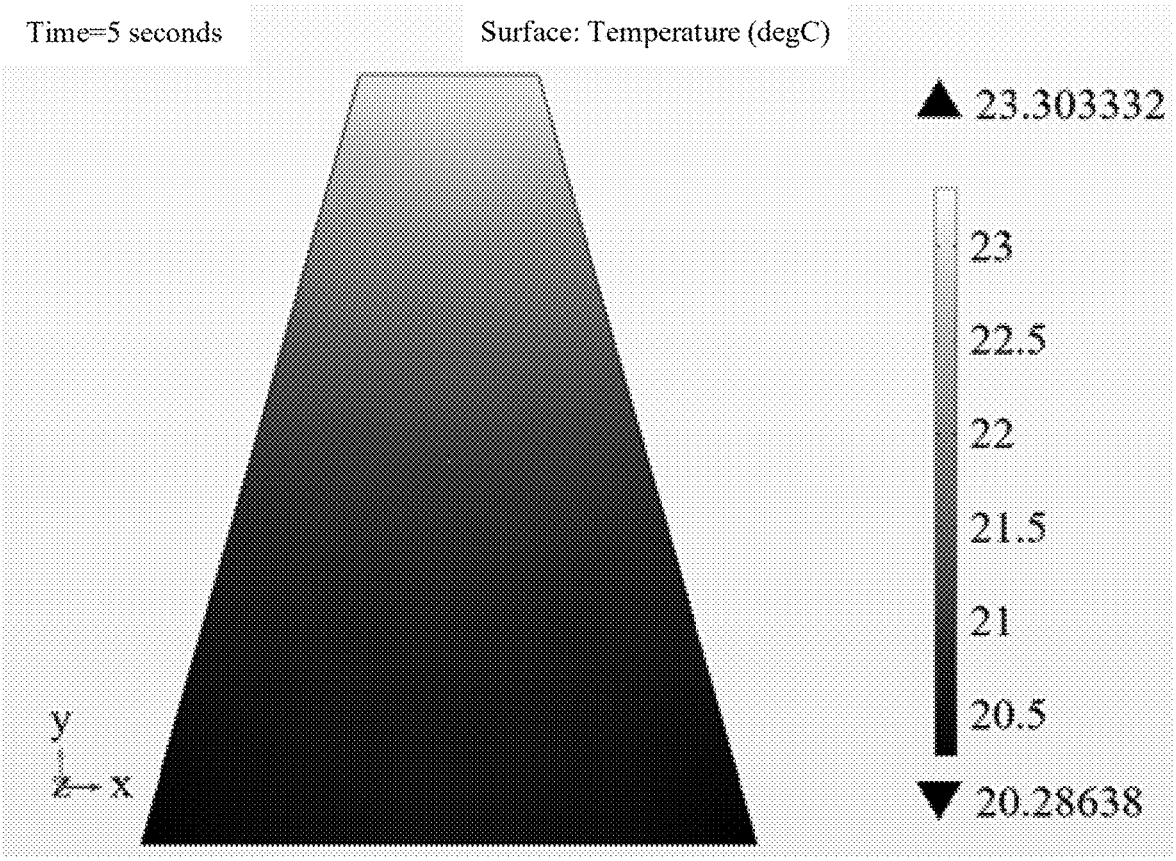
FIG. 4 is a cloud diagram of a temperature distribution of a sheet material to be formed having a trapezoidal shape at t=5 seconds.
Figure 5:
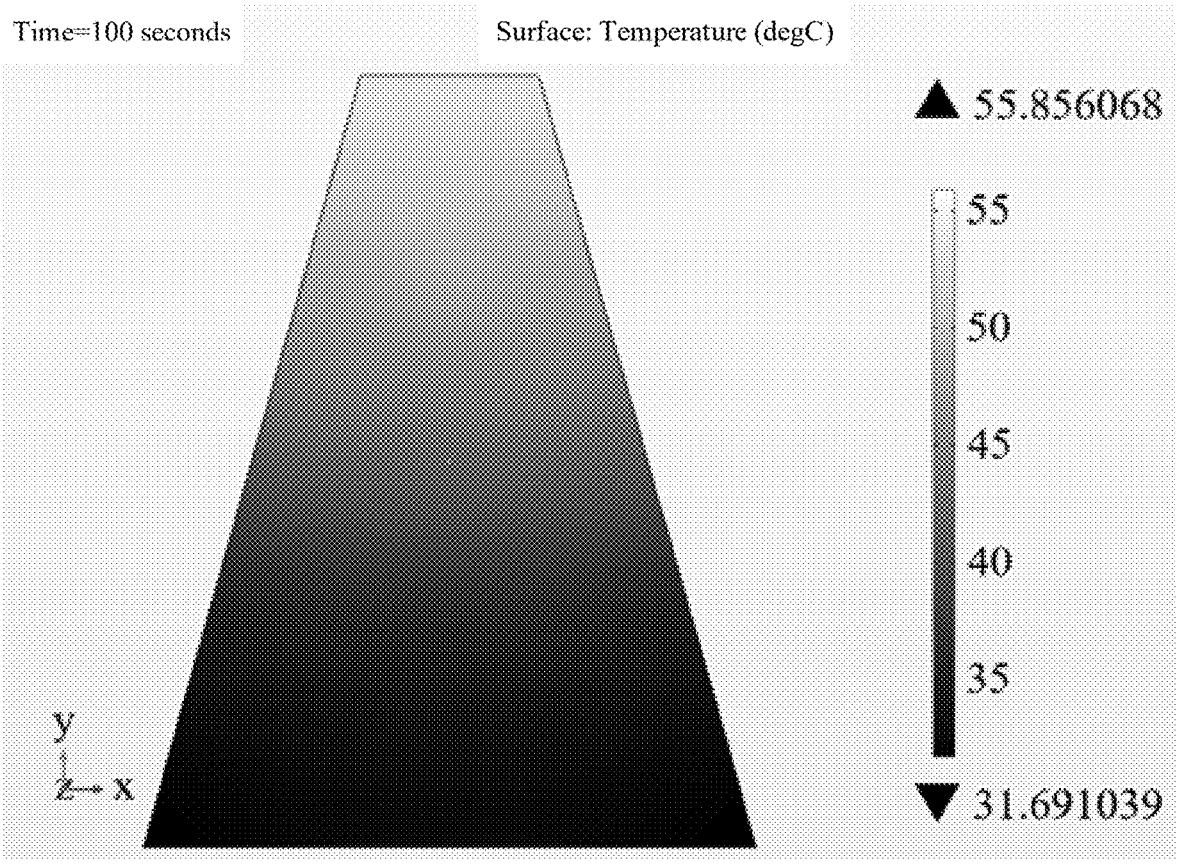
FIG. 5 is a cloud diagram of a temperature distribution of the sheet material to be formed having the trapezoidal shape at t=100 seconds.
Figure 6:
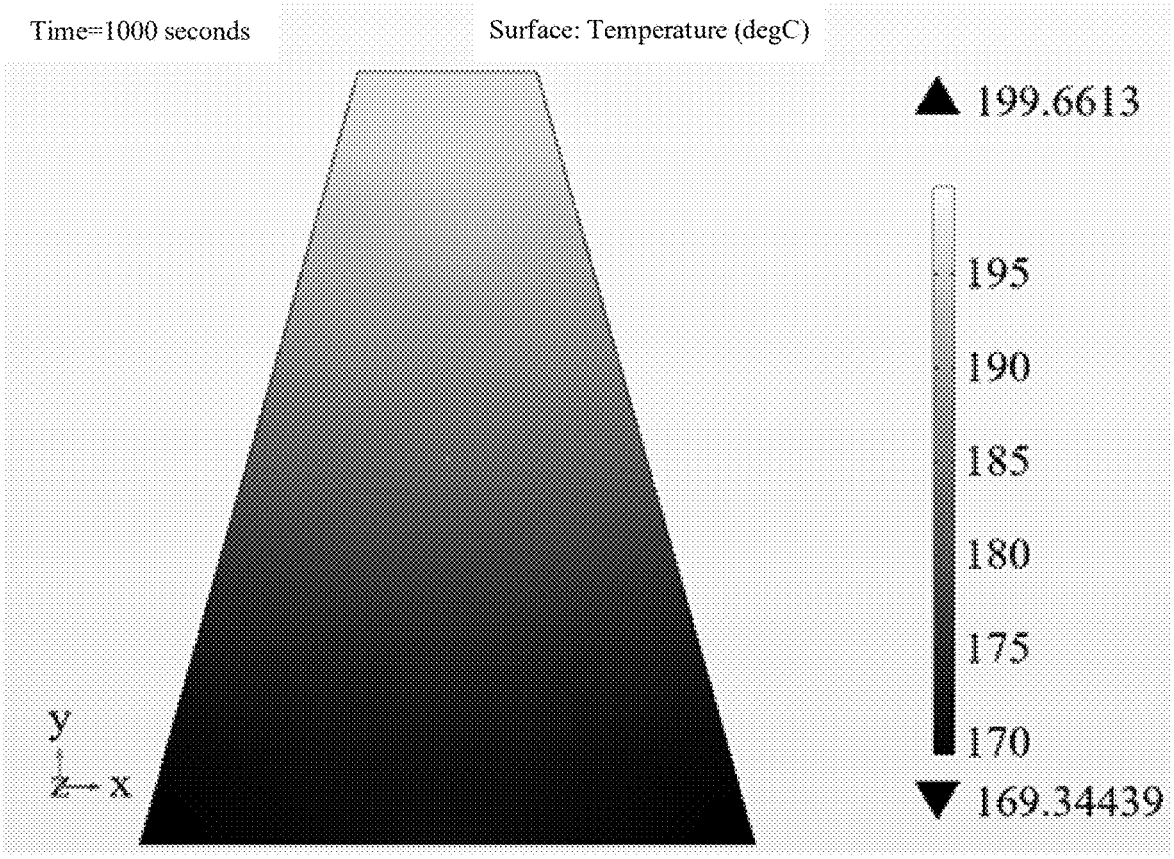
FIG. 6 is a cloud diagram of a temperature distribution of the sheet material to be formed having the trapezoidal shape at t=1000 seconds.
Figure 7:
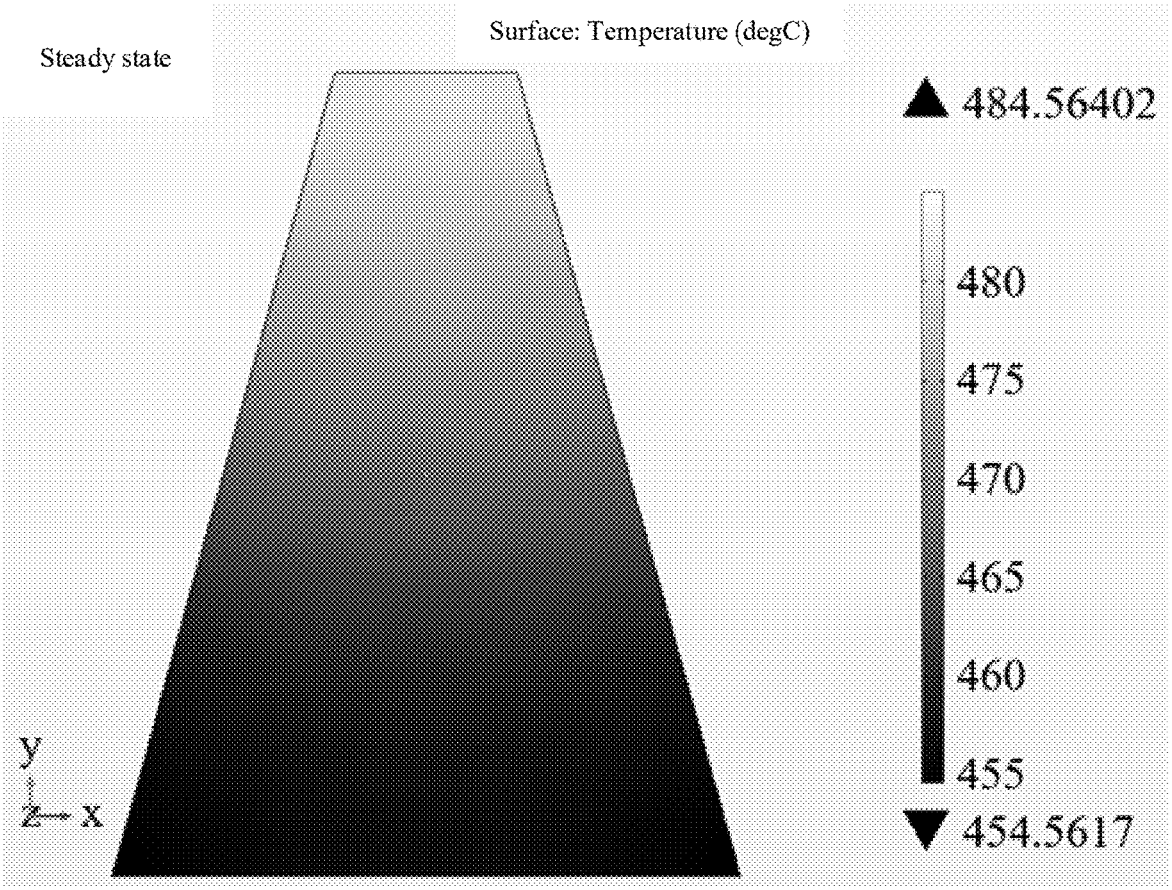
FIG. 7 is a cloud diagram of a temperature distribution of the sheet material to be formed having the trapezoidal shape in a steady state.
Figure 8:
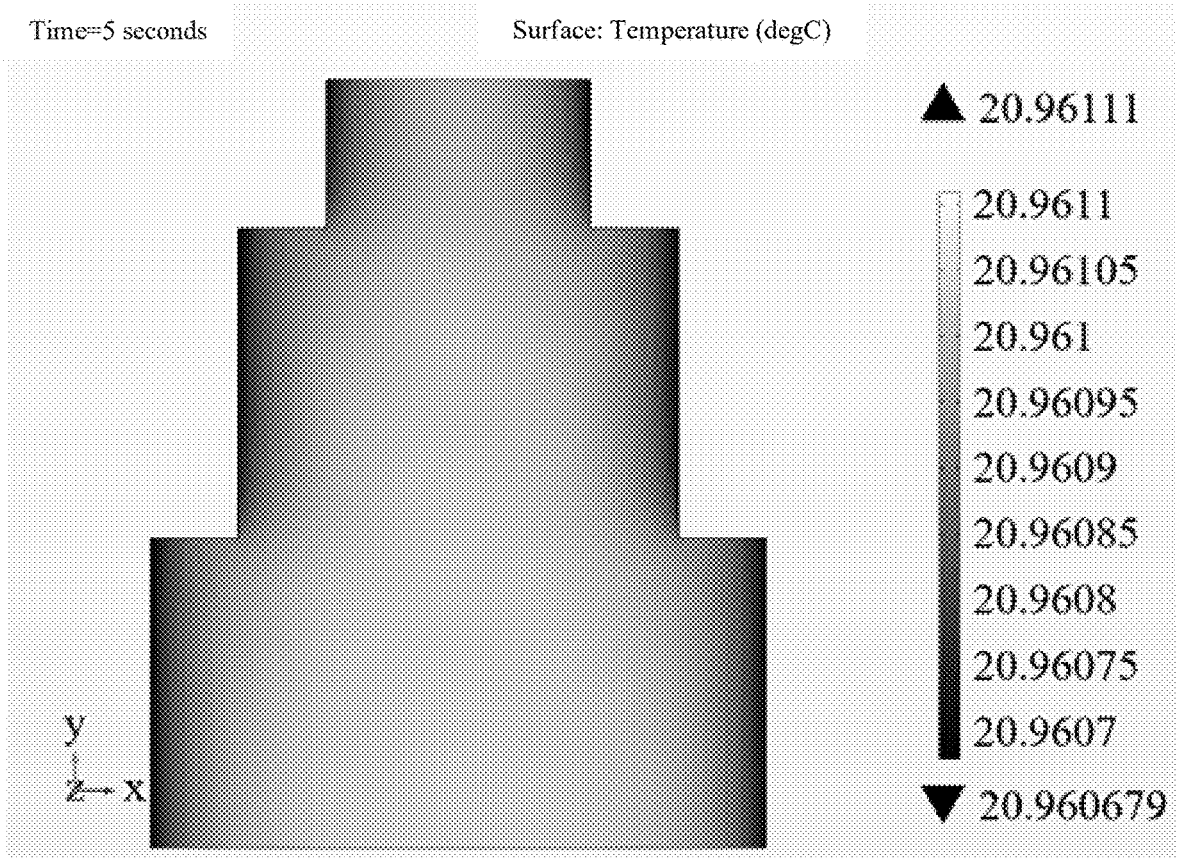
FIG. 8 is a cloud diagram of a temperature distribution of a sheet material to be formed having a stepped shape at t=5 seconds.
Figure 9:
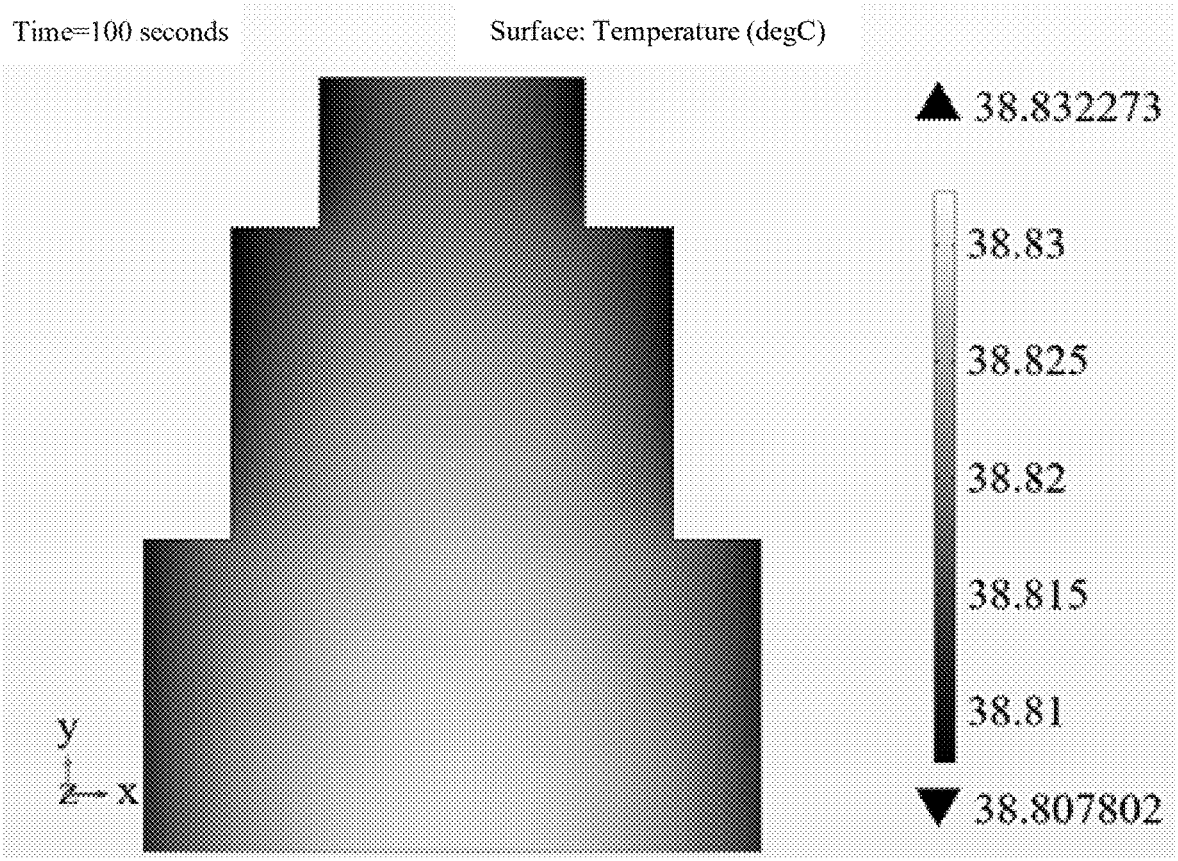
FIG. 9 is a cloud diagram of a temperature distribution of the sheet material to be formed having the stepped shape at t=100 seconds.
Figure 10:
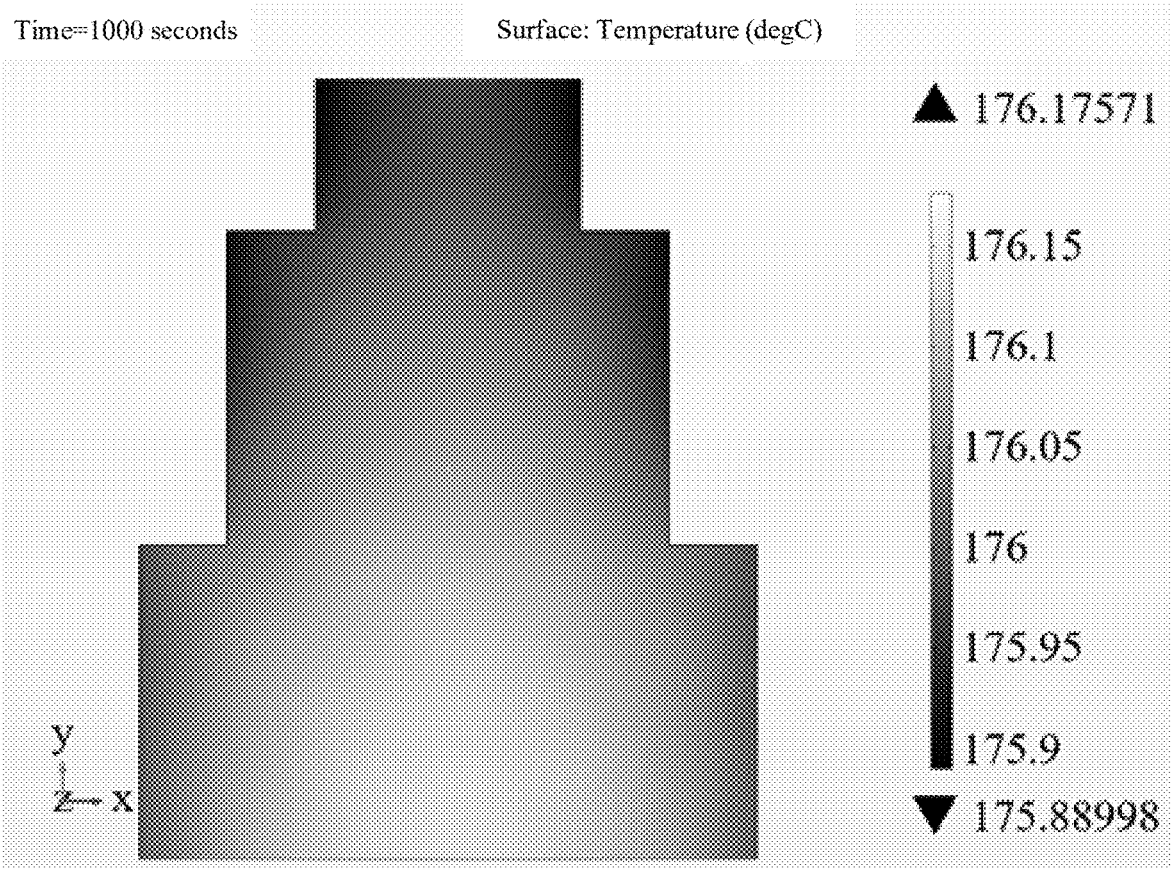
FIG. 10 is a cloud diagram of a temperature distribution of the sheet material to be formed having the stepped shape at t=1000 seconds.
Figure 11:
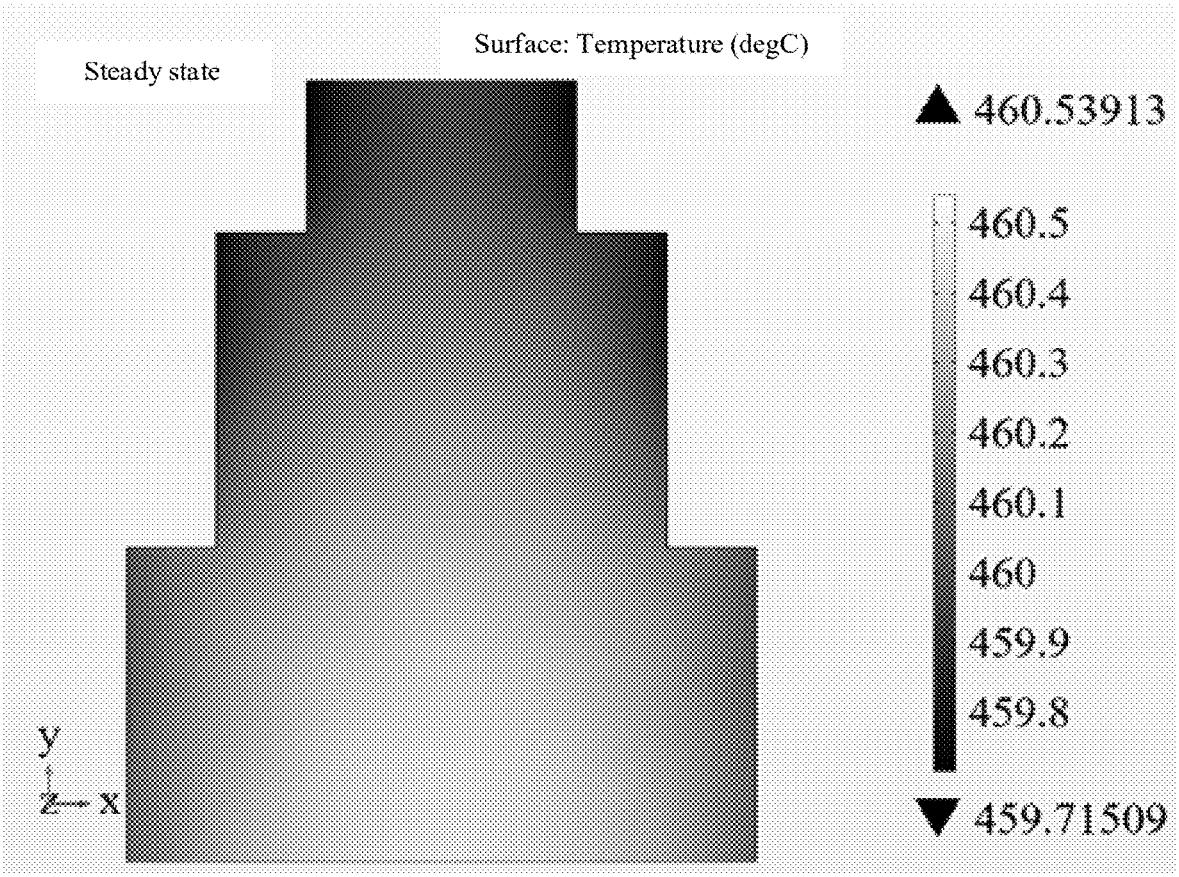
FIG. 11 is a cloud diagram of a temperature distribution of the sheet material to be formed having the stepped shape in a steady state.

Please refer to FIG. 1 to FIG. 3, the present application provides a method for forming a gourd petal component by using an electric pulse creep aging, the gourd petal component has a curved surface structure, the gourd petal component has an isosceles trapezoidal shape when the gourd petal component is flattened, and the method includes following steps.

Step S101, a sheet material is provided, and the sheet material is processed into a sheet material to be formed 100 having a preset shape.

In this embodiment, the sheet material is a rectangular rolled sheet with a certain thickness.

In the present application, the sheet material is an aluminum alloy. In this embodiment, the sheet material is a 2195-T34 aluminum-lithium alloy.

In this embodiment, a laser cutting or a water jet cutting is used to cut the sheet material into the sheet material to be formed 100 in the preset shape.

Please refer to FIG. 2 and FIG. 3 in detail. The sheet material to be formed 100 has a stepped structure, and includes a main body 10 having a structure same as a flattened structure 200 of the gourd petal component, and includes two stepped parts 20 which are symmetrically arranged and located on both sides of the main body 10.

In this embodiment, the flattened structure 200 of the gourd petal component has an isosceles trapezoidal shape that is narrow at a top and wide at a bottom. The main body 10 is the same as the flattened structure of the gourd petal component, that is, the main body 10 has the isosceles trapezoidal shape. Since the main body 10 has a certain thickness, it can also be understood that a longitudinal section of the main body 10 has the isosceles trapezoidal shape.

In the present application, the two stepped parts 20 have a same shape, and each stepped part 20 includes a plurality of stepped platforms 21 arranged parallel to a bottom surface of the main body 10, and a sum of lengths of all the stepped platforms and a length of a small end of the main body 10 is equal to a length of a large end of the main body 10, and two stepped platforms located on an uppermost end are in a same plane as a top surface of the main body 10, among them, all he stepped platforms and the small end of the main body together form M installation ends of different heights, and M is a positive integer greater than or equal to 2.

In this embodiment, the length of the stepped platform 21 refers to a length in an X direction as shown in FIG. 3.

In this embodiment, the small end of the main body 10 refers to an upper base of an isosceles trapezoid, and the large end of the main body 10 refers to a lower base of the isosceles trapezoid.

In the present application, the number of installation ends M is the same as a number of stepped platforms of each stepped part, that is, when the number of stepped platforms of each stepped part is three, the number of installation ends is also three, and when the number of stepped platforms of each stepped part equals four, the number of installation ends also equals four.

The M installation ends includes an installation end that is served together by the two stepped platforms at the uppermost end and the small end of the main body, and M-1 installation ends formed by other stepped platforms except the two stepped platforms at the uppermost end, among them, each two stepped platforms at a same height in the other stepped platforms serve as one installation end of the M-1 installation ends. That is, the stepped platforms at the same height in the two stepped parts serve as one installation end.

In one embodiment, the number of the stepped platforms 21 of each stepped part 20 equals 3 to 5, and correspondingly, the number of the installation ends equals 3 to 5.

In one embodiment, the number of the stepped platforms 21 of each stepped part 20 equals 3, and the number of the installation ends also equals 3.

In one embodiment, a cross-sectional area of each installation end is the same.

On a premise that a thickness (width) of each part of the sheet material to be formed is the same, it can also be understood that a length of each installation end is the same.

In the present application, shapes of the two stepped parts 20 are defined to be the same, so that the two stepped platforms at the same height can be used as one installation end to simultaneously apply a pulse current, which is convenient for subsequent intelligent adjustment of a current diversion. It can be understood that when the shapes of the two stepped parts 20 are different, as long as they have stepped platforms, a relatively uniform heating method can be achieved by controlling a number of connecting wires.

In this embodiment, along an extension of a side edge of the main body 10, the stepped part 20 is formed by sequentially stacking a plurality of triangular blocks whose longitudinal cross-sections are right-angled triangles, orthographic projections of the plurality of triangular blocks onto the bottom surface of the main body 10 do not overlap, and orthographic projections of adjacent triangular blocks onto the bottom surface of the main body 10 are connected.

The triangular block includes a first surface parallel to the bottom surface of the main body 10, a second surface perpendicularly bent and extended from the first surface, and a side surface connecting the first surface and the second surface. The first surface of the triangular block is the stepped platform 21, and the first surfaces of the plurality of triangular blocks form a plurality of stepped platforms 21 arranged parallel to each other. The side surface of the triangular block is in contact with and connected to the side edge of the main body.

It should be noted that, in the present embodiment, the main body 10 and the two stepped parts 20 are integrally formed. In order to describe specific structures of the main body 10 and the two stepped parts 20, they are named and described in detail respectively.

In this embodiment, the number of stepped platforms of each stepped part 20 equals 3, then each stepped part 20 is formed by stacking three triangular blocks.

Step S102, a plurality of first wires and a plurality of second wires are provided, a total number of the first wires is the same as a total number of the second wires, and all the second wires are divided into M groups of second wires based on the cross-sectional areas of the M installation ends, the M installation ends correspond to the M groups of second wires in a one-to-one correspondence, and a number of second wires corresponding to a unit cross-sectional area of each installation end is the same.

This step includes:

(1) The plurality of first wires and the plurality of second wires are provided based on a number of connection ports of a positive shunt bar and a number of connection ports of a negative shunt bar, the positive shunt bar and the negative shunt bar are connected to a current cabinet, and the total number of the first wires is the same as the total number of second wires;

The total number of the first wires and the total number of the second wires are determined based on the number of connection ports of the positive shunt bar and the number of connection ports of the negative shunt bar that are connected to the current cabinet, and the total number of the first wires and the total number of the second wires are less than or equal to the number of connection ports of the positive shunt bar and the number of connection ports of the negative shunt bar. When each of the positive shunt bar and the negative shunt bar has 20 connection ports, the total number of the first wires and the total number of second wires are less than or equal to 20, that is, up to 20 first wires and 20 second wires can be used to heat the sheet material to be formed.

(2) A cross-sectional area of each of the installation ends is calculated separately.

In the present application, the cross-sectional area of the installation end equals a product of the length in the X direction shown in FIG. 3 and the thickness of the sheet material to be formed.

The cross-sectional area of the installation end at the uppermost end equals a product of the length of the top surface in the X direction and the thickness of the sheet material to be formed, and the cross-sectional area of each of the other installation ends equals a product of a sum of the lengths of the two stepped platforms in the X direction and the thickness of the sheet material to be formed.

It can be understood that, except for the installation end at the uppermost end, each of the other installation ends correspond to two mounting positions, so a number of second wires corresponding to each of the other installation ends is an even number.

(3) A number of second wires to be installed at each installation end is determined based on the total number of the second wires and the cross-sectional area of each installation end.

For ease of understanding, an example is given, it is assumed that the total number of installation ends equals 3, of which the cross-sectional area of a first installation end (the installation end farthest from the bottom end) equals 3S, the cross-sectional area of a second installation end (a middle installation end) equals 2S, and the cross-sectional area of a third installation end (the installation end closest to the bottom end) equals S; then a ratio of a number of second wires installed at the first installation end: a number of second wires installed at the second installation end: a number of second wires installed at the third installation end is 6:4:2.

When the total number of the second wires equals 12, the number of second wires corresponding to the first installation end equals 6, the number of second wires corresponding to the second installation end equals 4, and the number of second wires corresponding to the third installation end equals 2.

When the cross-sectional area of each of the installation ends is the same, the number of second wires installed at each installation end is the same. If the total number of the second wires equals 12 and there are 3 installation ends, the number of second wires corresponding to each installation end equals 4.

(4) Based on the determined number of second wires to be installed at each installation end, all the second wires are divided into the M groups of second wires, the M installation ends correspond to the M groups of second wires in a one-to-one correspondence, and the number of second wires corresponding to the unit cross-sectional area of each installation end is the same.

Based on the example of step (3), the 12 second wires are divided into three groups, a first group of second wires includes 6 second wires, a second group of second wires includes 4 second wires, and a third group of second wires includes 2 second wires. The first group of second wires including 6 second wires corresponds to the first installation end, the second group of second wires including 4 second wires corresponds to the second installation end, and the third group of second wires including 2 second wires corresponds to the third installation end. In this way, the three installation ends correspond to the three groups of second wires one by one, and the number of second wires corresponding to the unit cross-sectional area of each installation end is the same.

When the cross-sectional area of each of the installation ends is the same, the number of second wires installed at each installation end is the same. If the total number of second wires equals 12 and there are 3 installation ends, each installation end is to be installed with 4 second wires.

The number of second wires corresponding to the unit cross-sectional area of each installation end is the same. It can be understood that this arrangement is to ensure that after a power supply is turned on, a current density in each area of the sheet material to be formed is the same.

Step S103, the sheet material to be formed is installed on a flexible mold, one end of each of the plurality of first wires is connected to the bottom end of the sheet material to be formed and the other end of each first wire is connected to the current cabinet, and one end of each second wire in each group of second wires is connected to the corresponding installation end and the other end of each second wire is connected to the current cabinet, the plurality of first wires and the plurality of second wires are respectively arranged opposite to each other and are evenly distributed. It should be noted that here the "the plurality of first wires and the plurality of second wires are respectively arranged opposite to each other and are evenly distributed" indicates that a line connecting a positive pole and a negative pole of each wire is parallel to each other, so as to enable a current distribution as uniform as possible.

The flexible mold provided in this step can be a flexible mold provided in the prior art, and the present application does not improve a structure of the flexible mold. Specifically, the flexible mold is used to absorb the sheet material to be formed through a vacuum sucker.

It should be noted that the sheet material to be formed can be installed on the flexible mold by directly placing the sheet material to be formed on the flexible mold, or the sheet material to be formed and the flexible mold can be detachably connected to each other. Both methods do not affect the implementation of the present application.

In the present application, the other end of each of the plurality of first wires and the other end of each of the plurality of second wires are connected to the current cabinet through the positive shunt bar and the negative shunt bar, respectively.

In the present application, the current cabinet can emit a pulse current of 0-6000 A.

In this embodiment, a number of current cabinets equals 6, and the 6 current cabinets can emit a current of 0-36000 A, so an adjustment range of the current is particularly large.

In the present application, currents generated by the six current cabinets converge on the positive and negative shunt bars, and then the currents are applied to the sheet material to be formed through the wires connected to the positive and negative shunt bars.

In the present application, a connection between the first wire and the bottom end and a connection between the second wire and the installation end are both achieved by using C-shaped buckles, and a specific connection method is as follows: a terminal of the first wire/the second wire and the sheet material to be formed are both clamped in a clamping groove of the C-shaped buckle, and then the terminal of the first wire/the second wire and the sheet material to be formed are fastened and connected by a bolt of the C-shaped buckle, and the terminal of the first wire/the second wire and an upper surface/lower surface of the sheet material to be formed are abutted to be conductive.

A method for installing the plurality of first wires is as follows: the plurality of first wires are evenly installed at the bottom end of the sheet material to be formed along a length direction of the sheet material to be formed.

In this embodiment, the bottom end of the sheet material to be formed refers to the large end of the main body.

A method for installing the plurality of second wires is as follows: the plurality of second wires are evenly installed at the installation ends along a length direction of the installation end, specifically: when the installation end is the installation end farthest from the bottom end, the group of second wires corresponding to the installation end are evenly distributed along the length direction of the installation end; when the installation end is not the installation end at the uppermost end (i.e., the installation end farthest from the bottom end), the group of second wires corresponding to the installation end are divided into two halves, and two stepped platforms constituting the installation end are evenly installed with half of the number of second wires respectively.

Step S104, a power supply is turned on, electric pulses are applied to M areas including different installation ends respectively, so that the current flows from one end of the sheet material to be formed to the other end of the sheet material to be formed to heat each area of the M areas of the sheet material to be formed respectively, each area of the M areas has a regular shape and the current density applied to each area is the same.

In the present application, when the one end of the sheet material to be formed is the bottom end, the other end of the sheet material to be formed is the plurality of installation ends; when the one end of the sheet material to be formed is the plurality of installation ends, the other end of the sheet material to be formed is the bottom end. That is, in the present application, the first wire can be connected to a positive pole of the current cabinet, or it can be connected to a negative pole of the current cabinet, and all the first wires are connected in the same way. That is, all the first wires are connected to the positive pole or all the first wires are connected to the negative pole, so as to ensure that a current direction of each area is the same. It can be understood that the first wire is connected to the positive pole of the current cabinet, and the second wire is connected to the negative pole of the current cabinet, or the first wire is connected to the negative pole of the current cabinet, and the second wire is connected to the positive pole of the current cabinet, so as to ensure a normal operation of a pulse device.

In the present application, the sheet material to be formed is heated in areas, a number of areas that has been divided is the same as the number of installation ends, and the divided areas correspond to the installation ends, and the current density in each area is ensured to be the same by controlling a number of second wires installed on the corresponding installation end.

For ease of understanding, a structure of the sheet material to be formed shown in FIG. 3 is used for illustration. The sheet material to be formed is divided into three areas for heating, and each area has a regular shape (rectangular area), the three areas includes a first area 10A (a rectangular area) including the first installation end, a second area 10B (two rectangular areas arranged at intervals) including the second installation end, and a third area 10C (two rectangular areas arranged at intervals) including the third installation end, among them, the first installation end is the installation end farthest from the bottom end, the second installation end is the middle installation end, and the third installation end is the installation end closest to the bottom end; accordingly, the first area 10A is located in a middle, the third area 10C is composed of two sub-areas located at outermost sides, and the second area 10B is composed of two middle sub-areas sandwiched between the first area 10A and the third area 10C. In the present application, the pulse current is applied to the first area 10A, the second area 10B, and the third area 10C for heating, respectively, and the current density applied to each area is the same.

In this example, in order to facilitate an intelligent adjustment, the cross-sectional area of the installation end corresponding to each area is the same, and a duty cycle of an applied pulse current is the same. In this way, it is only necessary to control the number of second wires connected to the installation end corresponding to each area to ensure that the current density in each area is close to each other, thereby achieving a uniform heating method.

In one embodiment, electric pulses are applied to the plurality of areas at off-peak hours, and a sum of the duty cycle of the pulse current applied to each area is less than 100%.

This method is used to ensure that the currents in areas with the same cross-sectional area are the same.

For ease of understanding, further examples are given based on the above examples. Electric pulses are applied at off-peak hours can be understood as when there is the pulse current in the first area, there is no pulse current in the other two areas; when there is the pulse current in the second area, there is no pulse current in the other two areas; when there is the pulse current in the third area, there is no pulse current in the other two areas. An intelligent adjustment allows pulse currents with different duty cycles to operate at different peaks. Here, it is necessary to ensure that the sum of the duty cycles of pulse currents in different areas is less than 100%. If the sum of the duty cycles of pulse currents in different areas is less than 100%, a difference between the sum of the duty cycles and 100% must be used as a vacancy period (that is, there is no current in the three areas at this time) to ensure that the currents in the three areas are the same. Through the above method, it is ensured that only one area is powered in each time period. When the duty cycles of different areas are the same and the corresponding cross-sectional areas of the installation ends are the same, the number of installed second wires is controlled to ensure that the current density in each area is close to each other, thereby achieving a relatively uniform heating method.

In this embodiment, based on the premise that the total number of second wires provided is 12, the three installation ends have the same cross-sectional area and are respectively connected to four second wires.

In the present application, based on the fact that the sum of the duty cycle of the pulse current in each area is less than 100%, the number of the plurality of installation ends is determined to be 2 to 5.

Specifically, due to a limitation that the sum of the duty cycles of the pulse currents corresponding to the plurality of areas is less than 100%, and the duty cycle of each area is the same, when the number of the plurality of areas equals 5, the duty cycle of the pulse current applied to each area must be less than 20%. If the number of the plurality of areas is greater than 5, the duty cycle of the pulse current applied to each area is even smaller, affecting a forming efficiency.

In the present application, pulse parameters corresponding to the applied electric pulse are determined by the following method:

(1) Pulse parameters for reaching a target temperature are determined based on an experiment with given pulse parameters making for a sheet material to be formed, the target temperature is a preset temperature of a creep age forming, among them, the pulse parameters include a pulse frequency, a pulse current density, and a duty cycle.

In order to achieve the target temperature, the pulse parameters determined based on the experiment can be in a variety of combinations, and it is sufficient as long as the target temperature can be reached when heating is performed using the pulse parameters.

This step can be understood as, if it is necessary to make the sheet material to be formed by the creep age forming at the target temperature, an experiment with given pulse parameters is first carried out on an experimental component having the same material as the sheet material to be formed to obtain the corresponding pulse frequency, the corresponding duty cycle and the corresponding pulse current for reaching the target temperature, among which, the pulse current=pulse current density*area. Under a premise of knowing the pulse current density and the cross-sectional area of the experimental component, the pulse current can be calculated using the formula.

In one embodiment, the duty cycle of the pulse current is 10-50%.

The pulse frequency, the duty cycle and the pulse current are all associated with the target temperature, and the three parameters determined in a same experiment have a corresponding relationship. Those skilled in the art can obtain the pulse current density corresponding to the target temperature according to a preset pulse frequency and a preset duty cycle, and the preset pulse frequency and the preset duty cycle can be preset according to experiences.

For example, under a condition of an indoor temperature of 25° C. and still wind, for the 2195-T34 aluminum-lithium alloy, an experiment shows that when the frequency is 300 Hz, the duty cycle is 40%, and the current density is 18 A/mm2, the target temperature can reach 185° C.

(2) Based on the pulse parameters that have been determined, a temperature of a creep age deformation at the target temperature is maintained by adjusting a current using a proportion integration differentiation (PID).

Specifically, the above steps determine the duty cycle, the pulse frequency and the pulse current for reaching the target temperature. In this step, it is only necessary to ensure that the temperature of the sheet material to be formed can exceed the target temperature. When the duty cycle and the pulse frequency are determined by the above step, the pulse current density that is applied is greater than the pulse current density determined by the above step. When the temperature of the sheet material to be formed is close to the target temperature, the current is gradually reduced, and a magnitude of the current is continuously adjusted to stabilize the temperature of the sheet material to be formed within ±2° C. of the target temperature.

Step S105, when the temperature of the sheet material to be formed reaches a creep aging temperature, the flexible mold is adjusted to form a target mold surface, and a load is applied by the vacuum sucker on a top of the flexible mold to adsorb the sheet material to be formed, and the target mold surface matches a shape of the gourd petal component.

In the present application, the sheet material to be formed is the 2195-T34 aluminum-lithium alloy, and its corresponding creep aging temperature is 160-185° C.

The pulse current is used to operate each area of the sheet material to be formed at off-peak hours, and each area is heated separately. When an overall temperature of the sheet material to be formed reaches the creep aging temperature, the material to be formed has been softened. At the time, the sheet material to be formed that has been softened is adsorbed by the vacuum sucker, which can better fit the flexible mold, thereby improving the forming quality.

Step S106, a temperature generated by the load and the pulse current is maintained for a preset time length to allow the sheet material to be formed to undergo a creep age forming, then the load and the pulse current are unloaded, and the gourd petal component including an edge material is obtained after a rebound.

Those skilled in the art know that the component obtained by the creep age forming also includes the edge material that is excessive, which needs to be removed to obtain the gourd petal component. The technology of removing the edge material can adopt the existing technology and does not belong to the improvement of the present application.

In the present application, the sheet material to be formed is the 2195-T34 aluminum-lithium alloy, the corresponding creep aging temperature is 160-185° C., and the preset time length is 3-25 h.

When the corresponding creep aging temperature is 185° C., the preset time length is 3-5 hours; when the corresponding creep aging temperature is 160° C., the preset time length is 20-25 hours.

A main difference between step S106 and the step of the creep age forming provided in the prior art is that the present application utilizes the pulse current for heating to keep the sheet material to be formed at the creep aging temperature for a preset time length, which is different from heating by an autoclave.

The present application processes the sheet material to be formed into a preset shape so that the sheet material to be formed consists of a plurality of rectangular areas, and then installs a number of second wires according to the corresponding cross-sectional area of the rectangular area to ensure that the current density of each rectangular area is the same, thereby ensuring that the temperature distribution of each area is the same, thereby achieving a purpose of a temperature uniformity; and the electric pulse has a Joule heating effect, which can cause a creep deformation of the component. At the same time, a non-thermal effect of the electric pulse causes the material to soften, improve a plasticity, and be more conducive to a deformation.

In one embodiment, the method further includes a shaping step, in which a separate pulse heating is performed on a rectangular area including an under-formed part or a difficult-to-deform part.

In the process of the creep age forming of an irregular component such as the gourd petal component, this method can be used to discretize the irregular component, thereby achieving a uniform application of electric pulses and a relatively uniform distribution of the temperature and a relatively uniform distribution of the deformation. In a subsequent correction process, for the under-formed part or the difficult-to-deform part, the rectangular area where the part is located can be heated by a separate electric pulse, thereby achieving a precise control of the deformation.

A simulation analysis is separately performed on a sheet material to be formed having a trapezoidal shape and a sheet material to be formed having a stepped shape provided by the present application, and cloud maps of temperature distributions obtained are shown in FIG. 4 to FIG. 11, among them, FIG. 4 to FIG. 7 are cloud maps of temperature distributions of the sheet material to be formed having the trapezoidal shape, and FIG. 8 to FIG. 11 are cloud maps of temperature distributions of the sheet material to be formed having the stepped shape provided by the present application. By comparing FIG. 4 to FIG. 7 with FIG. 8 to FIG. 11, it can be seen that when the sheet material to be formed having the stepped shape provided by the present application is used for a simulation experiment of the creep age forming, the temperature distribution is more uniform.

The sheet material to be formed having the trapezoidal shape is a sheet material with the same flattened structure as the gourd petal component, and is also a sheet material provided by the current prior art.

The beneficial effects of the present application include at least:

First. The present application provides a method for forming a gourd petal component by using an electric pulse creep aging. The method processes a sheet material to be formed into a stepped shape. The sheet material to be formed consists of a main body and stepped parts respectively located on both sides of the main body. Each of the stepped parts includes a plurality of stepped platforms arranged in parallel with a bottom surface of the main body. All the stepped platforms and a small end of the main body together form M installation ends with different heights. When a heating is performed by using electric pulses, the M areas including different installation ends are heated separately. Since each area is a regular rectangular area, the current density applied to each area can be better controlled to be the same. In this way, when a creep aging forming is performed, a temperature distribution of each area of the sheet material to be formed is uniform, which solves the problem of the uneven current density distribution when the sheet material to be formed having a trapezoidal shape is heated in the prior art, thereby improving the forming quality of the gourd petal component.

Second. The method of forming a gourd petal component using the electric pulse creep aging provided by the present application utilizes electric pulses to heat the sheet material to be formed having a stepped shape, and has the advantages of a uniform temperature distribution, a high forming efficiency and a good forming quality.

The above contents are further detailed descriptions of the present application in combination with specific preferred embodiments, and it cannot be determined that the specific implementation of the present application is limited to these descriptions. For ordinary skilled in the art to which the present application belongs, several simple deductions and substitutions can be made without departing from the concept of the present application, which should be regarded as belonging to the protection scope of the present application.

What is claimed is:

1. A method for forming a metal component using electric pulse creep aging, the metal component having a curved surface structure, and the metal component having an isosceles trapezoidal shape when the metal component is flattened, wherein the method comprises following steps:

step (1), providing a sheet material, and processing the sheet material into a sheet material to be formed having a preset shape, wherein the sheet material to be formed comprises a main body and two stepped parts, the main body has a same structure as a flattened form of the metal component, the main body in the isosceles trapezoidal shape has a top surface corresponding to a shorter one of two parallel sides of the isosceles trapezoidal shape, a bottom surface corresponding to a longer one of the two parallel sides of the isosceles trapezoidal shape, and two slanted sides between the top surface and the bottom surface, and the two stepped parts are symmetrically arranged and located on the slanted sides of the main body, each of the stepped parts comprising a plurality of stepped platforms arranged parallel to the bottom surface of the main body, and two stepped platforms are in a same plane as the top surface of the main body, wherein all the stepped platforms and the top surface of the main body together form M installation ends of different heights, and M is a positive integer greater than or equal to 2;

step (2), providing a plurality of first wires and a plurality of second wires, a total number of the first wires being the same as a total number of the second wires; and dividing all the second wires into M groups of second wires based on cross-sectional areas of the M installation ends such that each unit cross-sectional area of each installation end has a same number of second wires;

step (3), installing the sheet material to be formed on a flexible mold, and connecting one end of each of the plurality of first wires to the bottom surface of the main body and connecting the other end of each first wire to a current cabinet, and connecting one end of each second wire in each group of second wires to the corresponding installation end and connecting the other end of each second wire to the current cabinet, wherein the plurality of first wires and the plurality of second wires are respectively arranged opposite to each other and are evenly distributed;

step (4), turning on a power supply, applying electric pulses to M installation ends respectively, so that a current flows from one end of the sheet material to be formed to the other end of the sheet material to be formed to heat the sheet material to be formed, each area of the M installation ends having a regular shape and a current density applied to each area is the same; wherein in the step (4), electric pulses are applied to the M installation ends in a staggered manner, and when the electric pulses is applied to a target area, no electric pulses is applied to other areas, and a sum of the duty cycle of the pulse current applied to each area is less than 100%, wherein the target area is any one of the M installation ends, and the other areas are all areas of the M installation ends excluding the target area;

step (5), when the temperature of the sheet material to be formed reaches a creep aging temperature, adjusting the flexible mold to form a target mold surface, the target mold surface matching a shape of the metal component;

Step (6), maintaining a temperature generated by a load and the electric pulses for a preset time length to allow the sheet material to be formed to undergo a creep aging forming, and unloading the load and the current that is applied, and obtaining the metal component including an edge material after a rebound.

2. The method for forming the metal component using electric pulse creep aging according to claim 1, wherein the step (2) further comprises:

based on a number of connection ports of a positive shunt bar and a number of connection ports of a negative shunt bar connected to the current cabinet, providing the plurality of first wires and the plurality of second wires of the same number;

calculating a cross-sectional area of each of the installation ends separately; and determining a number of second wires to be installed at each installation end based on the total number of the second wires and the cross-sectional area of each installation end such that each unit cross-sectional area of each installation end has a same number of second wires.

3. The method for forming the metal component using electric pulse creep aging according to claim 1, wherein the cross-sectional area of each installation end is the same, a number of second wires installed at each installation end is the same, and the duty cycle of the pulse current in each area is the same.

4. The method for forming the metal component using electric pulse creep aging according to claim 1, wherein the sheet material to be formed is a 2195-T34 aluminum-lithium alloy, the corresponding creep aging temperature is 160~185° C., and the preset time is 3~25 h.

5. The method for forming the metal component using electric pulse creep aging according to claim 1, wherein pulse parameters corresponding to the electric pulse applied in step (4) are determined by a following method, comprising:

determining pulse parameters for reaching a target temperature based on an experiment with given pulse parameters making for the sheet material to be formed, the target temperature being a preset temperature of a creep age forming, wherein the pulse parameters comprise a pulse frequency, a pulse current density, and a duty cycle;

based on the pulse parameters that have been determined, maintaining a temperature of a creep age deformation at the target temperature by adjusting a current using a proportion integration differentiation (PID).

6. The method for forming the gourd petal metal component using electric pulse creep aging according to claim 1, wherein a number of the stepped platforms of each stepped part is 3 to 5.

7. The method for forming the metal component using electric pulse creep aging according to claim 4, wherein when the creep aging temperature is maintained at 185° C., the preset time length is 3 to 5 hours; when the creep aging temperature is maintained at 160° C., the preset time length is 20 to 25 hours.

8. The method for forming the metal component using electric pulse creep aging according to claim 6, wherein the two stepped platforms at the uppermost end and the top surface of the main body together serve as one installation end, and for other stepped platforms except the two stepped platforms at the uppermost end, each two stepped platforms at a same height serve as one installation end.

* * * * *